US012337885B2

(12) United States Patent
Dunn et al.

(10) Patent No.: US 12,337,885 B2
(45) **Date of Patent: *Jun. 24, 2025**

(54) SYSTEM AND/OR METHOD FOR REMOTE OPERATION OF A RAIL VEHICLE

(71) Applicant: Parallel Systems, Inc., Los Angeles, CA (US)

(72) Inventors: Patrick Dunn, Los Angeles, CA (US); Marc Greenbaum, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/635,008

(22) Filed: Apr. 15, 2024

(65) Prior Publication Data

US 2024/0278817 A1 Aug. 22, 2024

Related U.S. Application Data

(63) Continuation of application No. 18/514,946, filed on Nov. 20, 2023, now Pat. No. 11,981,363.

(60) Provisional application No. 63/426,552, filed on Nov. 18, 2022.

(51) Int. Cl.
*B61L 27/30* (2022.01)
*B61L 27/04* (2006.01)

(52) U.S. Cl.
CPC ..... *B61L 27/30* (2022.01); *B61L 27/04* (2013.01)

(58) Field of Classification Search
CPC ..... B61L 27/30; B61L 27/04; B61L 27/20; B61L 15/0027; B61L 23/041; B61L 3/127
See application file for complete search history.

(56) References Cited

U.S. PATENT DOCUMENTS

| | | | |
|---|---|---|---|
| 3,848,533 | A | 11/1974 | Grow |
| 11,305,796 | B1 | 4/2022 | Shue et al. |
| 2004/0006413 | A1 | 1/2004 | Kane et al. |
| 2009/0184211 | A1 | 7/2009 | Groves et al. |
| 2012/0203419 | A1 | 8/2012 | Tucker et al. |

(Continued)

FOREIGN PATENT DOCUMENTS

| | | | |
|---|---|---|---|
| CA | 3074977 | A1 | 10/2020 |
| CN | 102521868 | A | 6/2012 |

(Continued)

OTHER PUBLICATIONS

Dunn, Patrick , et al., "Rail Authority System and/or Method", U.S. Appl. No. 18/373,225, filed Sep. 26, 2023.

(Continued)

*Primary Examiner* — Russell Frejd
(74) *Attorney, Agent, or Firm* — Jeffrey Schox; Diana Lin

(57) ABSTRACT

The method S100 can include: determining a remote operation request Silo; optionally determining a priority of the remote operation request S120; providing vehicle data to a remote operator S130; responding to the remote operation request S140; and optionally training a model based on the response S150. However, the method S100 can additionally or alternatively include any other suitable elements. The method S100 functions to facilitate remote assistance of a vehicle operating within a rail network (e.g., operation of unmanned vehicles within restricted track regions). Additionally or alternatively, the system can function to facilitate remote validation/verification of vehicle operations and/or rail infrastructure status.

21 Claims, 6 Drawing Sheets

(56) References Cited

U.S. PATENT DOCUMENTS

| | | | |
|---|---|---|---|
| 2015/0008294 | A1 | 1/2015 | Desbordes et al. |
| 2016/0368495 | A1 | 12/2016 | Luther et al. |
| 2016/0375888 | A1 | 12/2016 | Allwardt |
| 2017/0108876 | A1 | 4/2017 | Mullan et al. |
| 2017/0320507 | A1 | 11/2017 | Denny et al. |
| 2018/0079436 | A1 | 3/2018 | Fifield |
| 2018/0231972 | A1 | 8/2018 | Woon et al. |
| 2018/0339719 | A1 | 11/2018 | Loughlin |
| 2019/0054929 | A1 | 2/2019 | Yao et al. |
| 2019/0176862 | A1 | 6/2019 | Kumar et al. |
| 2019/0281052 | A1 | 9/2019 | Lekkas |
| 2019/0389498 | A1 | 12/2019 | Grimm et al. |
| 2021/0094567 | A1 | 4/2021 | Imai et al. |
| 2021/0094597 | A1 | 4/2021 | Rush et al. |
| 2021/0132625 | A1 | 5/2021 | Gillett |
| 2021/0188332 | A1 | 6/2021 | Brooks et al. |
| 2021/0291883 | A1 | 9/2021 | Gotlund et al. |
| 2022/0137623 | A1 | 5/2022 | Goyal et al. |
| 2022/0185350 | A1 | 6/2022 | Kindt et al. |
| 2024/0166250 | A1 | 5/2024 | Dunn et al. |

FOREIGN PATENT DOCUMENTS

| | | | |
|---|---|---|---|
| CN | 103164750 | A | 6/2013 |
| CN | 107948570 | A | 4/2018 |
| CN | 111414518 | A | 7/2020 |
| CN | 111652935 | A | 9/2020 |
| CN | 110758477 | B | 11/2021 |
| CN | 114067290 | A | 2/2022 |
| CN | 116664388 | A | 8/2023 |
| CN | 112613509 | B | 7/2024 |
| JP | 6851278 | B2 | 3/2021 |
| WO | 2017211593 | A1 | 12/2017 |
| WO | 2018026615 | A1 | 2/2018 |
| WO | 2018054616 | A1 | 3/2018 |
| WO | 2022192795 | A2 | 9/2022 |
| WO | 2022263144 | A1 | 12/2022 |

OTHER PUBLICATIONS

Dunn, Patrick , et al., "Rail Control System and/or Method", U.S. Appl. No. 18/499,034, filed Oct. 31, 2023.

Dunn, Patrick , et al., "System and/or Method for Remote Operation of a Rail Vehicle", U.S. Appl. No. 18/514,946, filed Nov. 20, 2023.

Fraga-Lamas, Paula , et al., "Towards the Internet of Smart Trains: A Review on Industrial IoT Connected Railways", Sensors, Jun. 21, 2017, URL: https://www.mdpi.com/1424-8220/17/6/1457.

Greenbaum, Marc , et al., "Railway Switch Management System and/or Method", U.S. Appl. No. 18/672,864, filed May 23, 2024.

Pendleton, Scott Drew, et al., "Perception, Planning, Control, and Coordination for Autonomous Vehicles", Google Scholar, M DPI Machines, Feb. 2017, pp. 1-54. (Year: 2017).

Sanaei , et al., "Interface for aRailway Control System", Chalmers University of Technology, Dec. 13, 2011, <URL: http://odr.chalmers.se/bitstreams/fcb1915c-254a-4c15-b364 66d99a4c2167/download>.

Singh, Prashant , "Deployment of Autonomous Trains in Rail Transportation: Current Trends and Existing Challenges", Google Scholar , IEEE Access, vol. 9, Jun. 2021, pp. 91427-91461. (Year: 2021).

Dunn, Patrick , et al., "Remote Rail Monitoring System and/or Method", U.S. Appl. No. 18/776,069, filed Jul. 17, 2024.

SYSTEM AND/OR METHOD FOR REMOTE OPERATION OF A RAIL VEHICLE

CROSS REFERENCE TO RELATED APPLICATIONS

This application is a continuation of U.S. Pat. No. 11,981,363, filed 20 Nov. 2023, which claims the benefit of U.S. Provisional Application No. 63/426,552, filed 18 Nov. 2022, each of which is incorporated herein in its entirety by this reference.

TECHNICAL FIELD

This invention relates generally to the transportation field, and more specifically to a new and useful remote operation system and/or method in the transportation field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview

Figure 1:
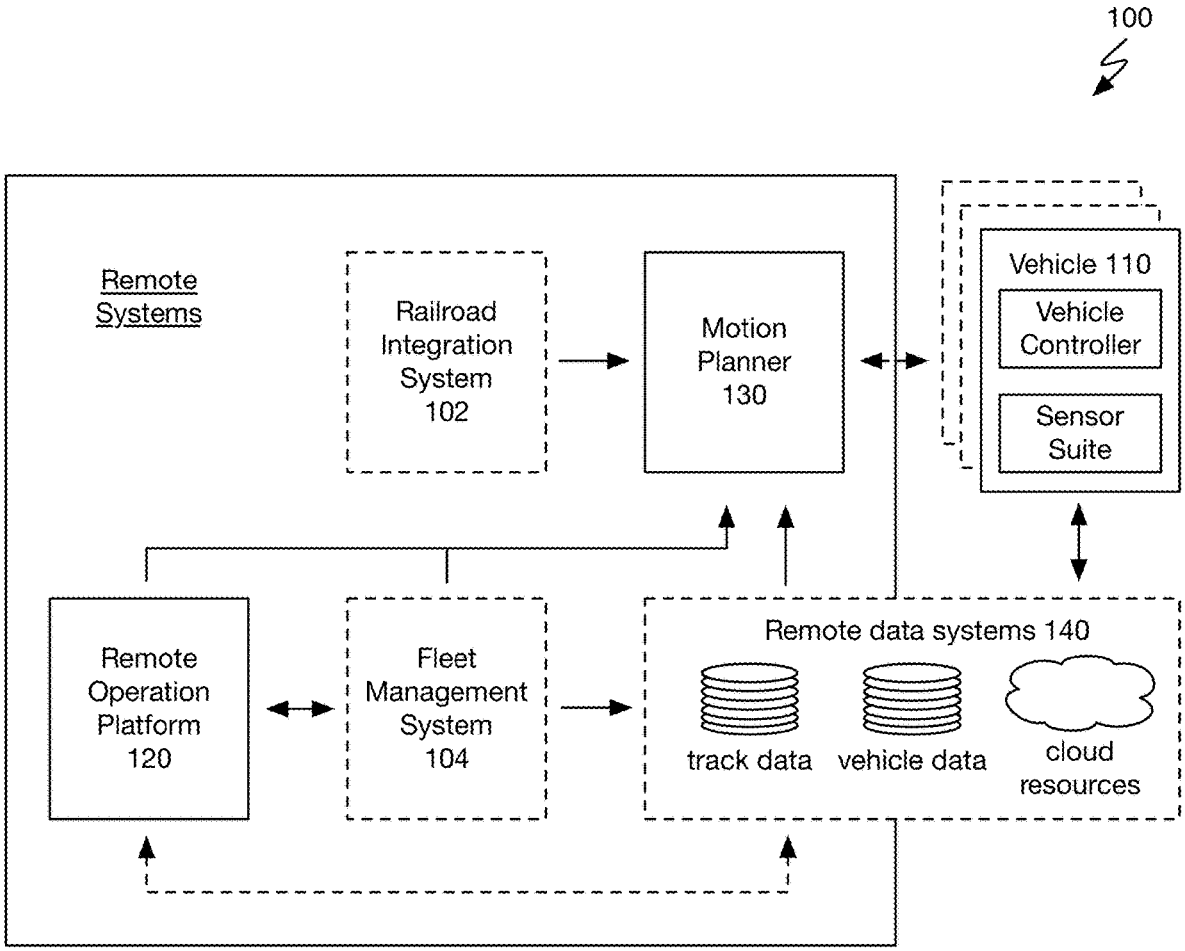
FIG. 1 is a schematic representation of a variant of the system.

The system 100, an example of which is shown in FIG. 1, can include: a vehicle 110 and a remote operator platform 120. The system can optionally include or be used with a motion planner 130 and a set of remote data systems 140. However, the system 100 can additionally or alternatively include any other suitable set of components. The system functions to facilitate remote assistance and/or prioritization of remote assistance for a vehicle(s) operating within a rail network. Additionally or alternatively, the system can function to manage authority within a rail network and/or to maintain state awareness of a rail network. Additionally or alternatively, the system can function to facilitate remote validation/verification of vehicle operations and/or rail infrastructure status. Additionally, the system functions to facilitate remote monitoring of a vehicle system(s), such as an unmanned rail vehicle, and/or positive train control (PTC) when operating under restricted-speed rules (e.g., within a restricted speed track region/zone). Additionally, the system can function to facilitate remote monitoring, tele-operation, and/or exception handling across multiple vehicles/trains by a single operator. Additionally, the system can function to adjust command of a remotely monitored vehicle based on the observability of the environment and/or response capability of a remote monitor/tele-operator (e.g., based on line-of-sight, video latency, etc.).

Figure 3:
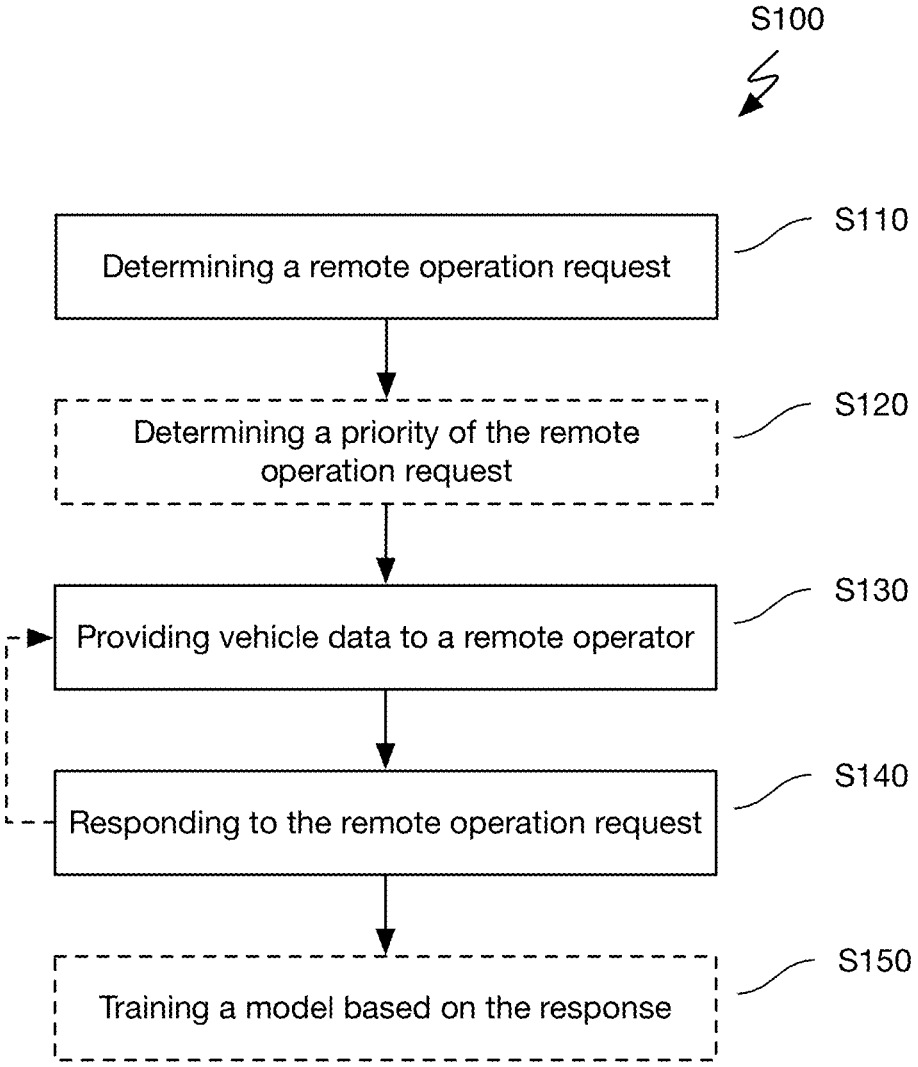
FIG. 3 is a flowchart diagram of a variant of the method.
Figure 4:
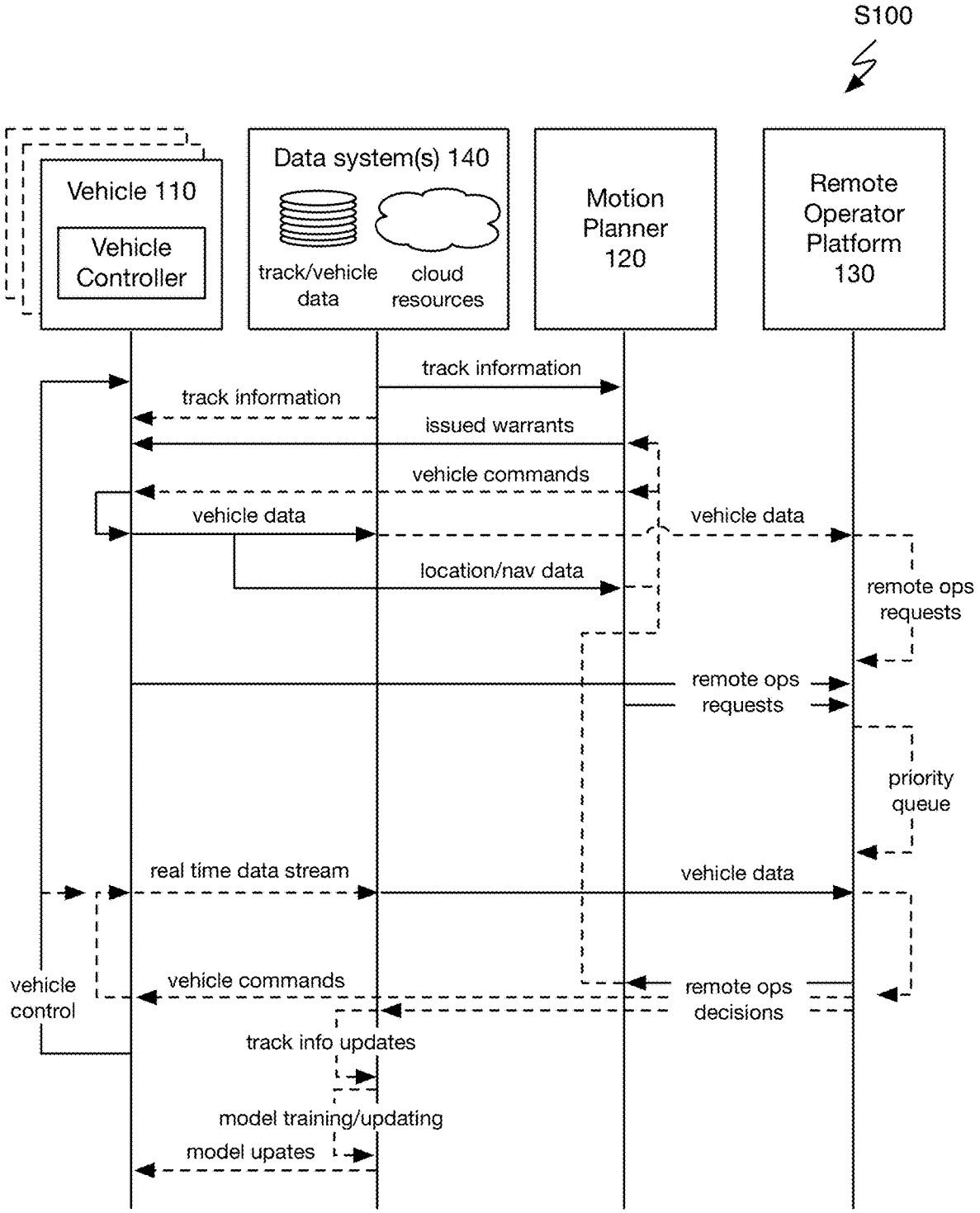
FIG. 4 is a flowchart diagram of the method for a variant of the system.

The method S100, an example of which is shown in FIG. 3, can include: determining a remote operation request Silo; optionally determining a priority of the remote operation request S120; providing vehicle data to a remote operator S130; responding to the remote operation request S140; and optionally training a model based on the response S150. However, the method S100 can additionally or alternatively include any other suitable elements. The method S100 functions to facilitate remote assistance of a vehicle operating within a rail network (e.g., operation of unmanned vehicles within restricted track regions). Additionally or alternatively, the system can function to facilitate remote validation/verification of vehicle operations and/or rail infrastructure status.

In variants, the system and/or method can function to facilitate vehicle remote assistance of an autonomous rail vehicle(s) as described in U.S. application Ser. No. 17/335,732, filed 1 Jun. 2021, and/or U.S. application Ser. No. 17/694,499, filed 14 Mar. 2022, each of which is incorporated herein in its entirety by this reference.

Figure 2:
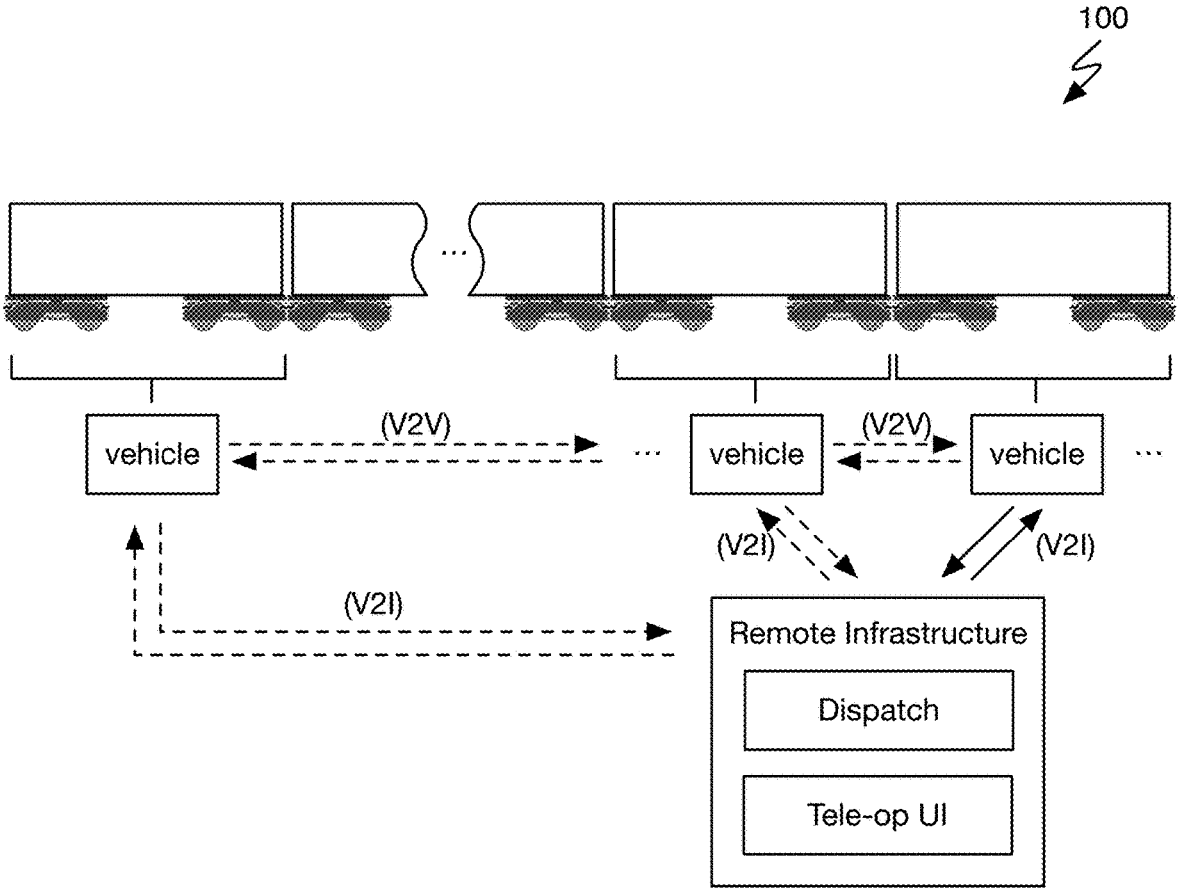
FIG. 2 is a schematic representation of a variant of the system.

In variants, the system and/or method can function to facilitate individual vehicle traversal and/or coordinated vehicle traversal (a.k.a., platooning) as described in U.S. application Ser. No. 17/732,143, filed 28 Apr. 2022, which is incorporated herein in its entirety by this reference. An example of coordinated vehicle traversal is shown in FIG. 2.

The term "substantially" as utilized herein can mean: exactly, approximately, within a predetermined threshold or tolerance, and/or have any other suitable meaning.

1.1 Illustrative Examples

Figure 5:
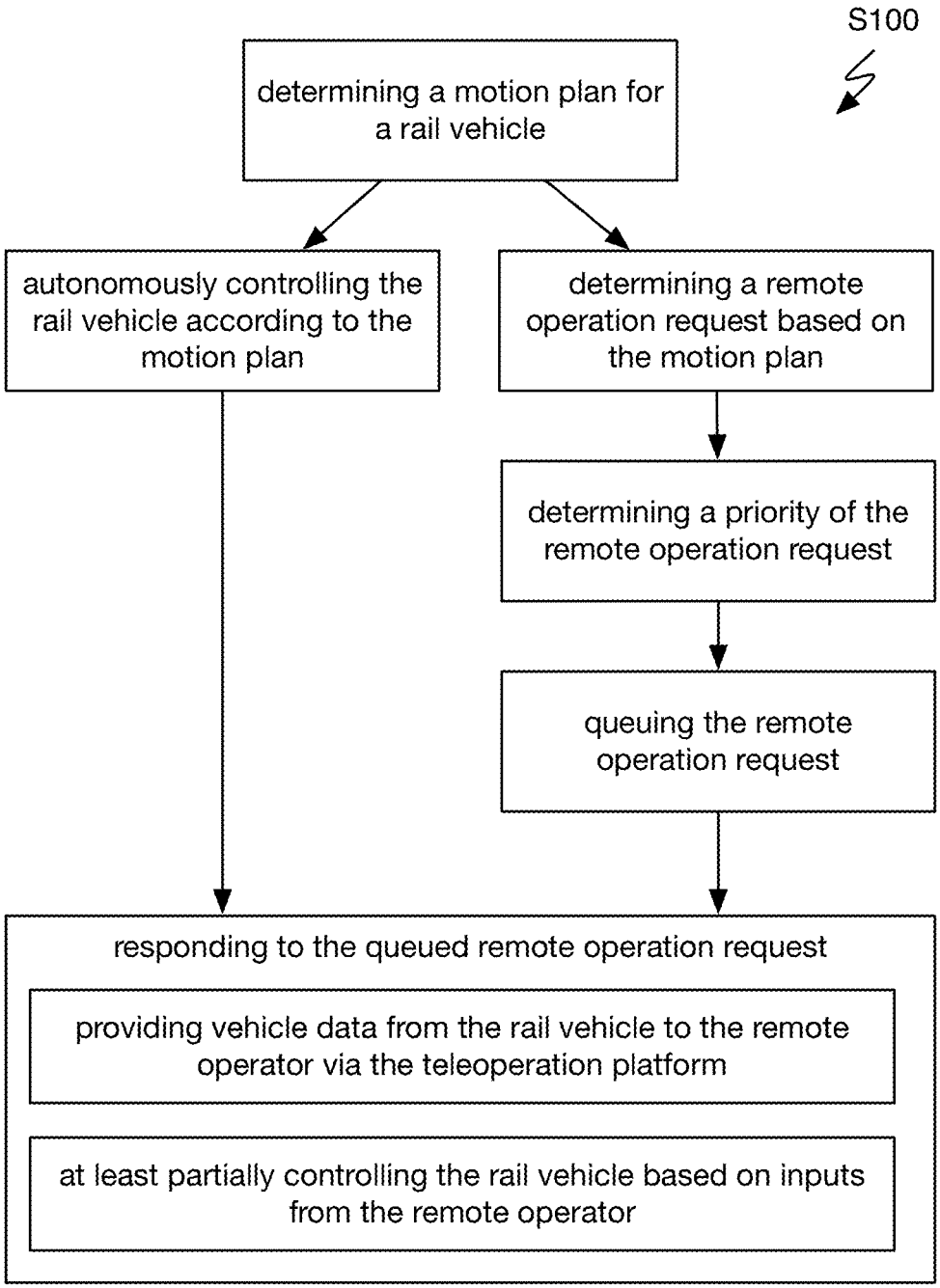
FIG. 5 is a flowchart diagram of a variant of the method.

In a first set of variants (e.g., an example is shown in FIG. 5, a method can include: determining a motion plan for a rail vehicle (e.g., with a motion planner); autonomously controlling the rail vehicle according to the motion plan; contemporaneously with autonomously controlling the rail vehicle, determining a remote operation request; determining a priority of the remote operation request; queuing the remote operation request at a teleoperation platform based on the priority; and responding to the queued remote operation request, including: providing vehicle data from the rail vehicle to the remote operator via the teleoperation platform; and at least partially controlling the rail vehicle based on inputs from the remote operator.

2. Benefits

Variations of the technology can afford several benefits and/or advantages.

First, variations of this technology can facilitate remote assistance of fully autonomous or semi-autonomous vehicles in a variety of contexts, which can enable traversal of autonomous rail vehicles under restricted operational requirements (e.g., within a restricted speed zone).

Second, variations of this technology can facilitate remote verification/auditing of track equipment by a remote operator (such as a remote train engineer), which may facilitate operation of an autonomous or semi-autonomous rail vehicle within restricted speed zones (e.g., where a train engineer verification of rail equipment operability may facilitate satisfaction of regulatory compliance) without a train engineer being physically present onboard the rail vehicle.

Third, variants can facilitate assistance of multiple rail vehicles or trains, which are contemporaneously in transit, by a single remote operator. In particular, verification, validation, and assistance of semi-/fully autonomous trains by remote operators may be utilized during only a small proportion time of a transit trip (e.g., less than 10%; less than 1%; etc.) and/or fraction of the distance of a transit trip (e.g., less than 10%, less than 1%, etc.; within restricted speed track regions and/or track regions with a railroad bulletin; along a spur; based on track rules; etc.). Such variants can implement a priority queuing system to efficiently distribute remote operation resources and human resource requirements amongst a plurality of vehicles operating within the network.

Fourth, variants can facilitate generation of supervised training datasets, which can be used to improve machine-learning (ML) and/or computer-vision (CV) based perception, navigation, and control, with data aggregated from the remote operation platform. In particular, perception data collected by trains may have a high degree of redundancy and/or may contain a low density of 'interesting' object occurrences or key events relative to time/distance traveled. Accordingly, remote operator inputs can be utilized to reduce redundancy in training data (e.g., by supervised learning; flagging key events; etc.), which may improve the accuracy of resulting ML-models and/or facilitate training of models with smaller datasets.

Fifth, variations of the technology can expedite vehicle reversal and/or direction change by allowing (remote) operators to toggle between perception feeds on opposing ends of the vehicle to improve operational efficiency (i.e., throughput), rail utilization, and/or reduce train downtime. As an example, a remote operator may toggle between views and/or observe them simultaneously to establish line-of-sight with the environmental surroundings and/or rail infrastructure (e.g., switch state) at opposite ends of a vehicle and/or train/platoon (e.g., as opposed to a train engineer being tasked with physically walking from one end of the train to the other or utilizing train engineers at either end of the train in order to make the same assessment). Additionally, teleoperators may toggle between video feeds of individual rail vehicles within a train/platoon to observe hazards, track features, and/or environmental conditions at various relative positions, without being physically located on-site.

However, variations of the technology can additionally or alternately provide any other suitable benefits and/or advantages.

3. System

The system 100, an example of which is shown in FIG. 1, can include: a vehicle 110 and a remote operator platform 120. The system can optionally include or be used with a motion planner 130 and a set of remote data systems 140. However, the system 100 can additionally or alternatively include any other suitable set of components. The system functions to facilitate remote assistance and/or prioritization of remote assistance for a vehicle(s) operating within a rail network. Additionally or alternatively, the system can function to manage authority within a rail network and/or to maintain state awareness of a rail network. Additionally or alternatively, the system can function to facilitate remote validation/verification of vehicle operations and/or rail infrastructure status. Additionally, the system functions to facilitate remote monitoring of a vehicle system(s), such as an unmanned rail vehicle, and/or positive train control (PTC) when operating under restricted speed rules. Additionally, the system can function to facilitate remote monitoring, tele-operation, and/or exception handling across multiple vehicles/trains by a single operator. Additionally, the system can function to adjust command of a remotely monitored vehicle based on the observability of the environment and/or response capability of a remote monitor/tele-operator (e.g., based on line-of-sight, video latency, etc.).

In variants, the system can optionally include or be used with a railroad integration system 102 which functions to translate authority grants from a railroad authority(ies) into a movement authority (a.k.a., macro-warrant) which can be provided to the motion planner (a.k.a., vehicle dispatch system). Additionally or alternatively, the railroad integration system can transform protocol-specific authority grants, issued by a railroad authority, into a unified/generalized form (e.g., movement authority). Additionally or alternatively, the railroad integration system can be used to update mapped track data based on information received from the railroad authority (e.g., map updates, track condition updates, track feature updates, etc.).

The railroad integration system can receive a set of inputs from the railroad authority, which can include: track signals, authorization forms, track feature updates, track condition updates, and/or any other suitable information. The set of inputs is preferably received according to a predetermined protocol, specific to a particular railroad authority, but can be received in any suitable data format. In a specific example, the railroad integration service can include an API (specific to a particular railroad authority; generalized API which can interface with each railroad authority; etc.). Additionally or alternatively, the railroad integration service can be integrated into an API Gateway, can communicate with an API Gateway (e.g., allowing the railroad integration system and/or railroad authority to communicate with the motion planner and/or track data system), and/or can be otherwise integrated with and/or interface with various components of the system.

The railroad integration system can determine a movement authority, or a (coarse) authority region of track, based on the inputs from the railroad authority. For example, the movement authority can be defined based on a starting and ending point along the track (e.g., coordinate point, in track map coordinates; relative to track nodes/features/segments, etc.) and can include a set of intervening track sections (e.g., relative to a track map). The inputs can be transformed into movement authorities based on a predetermined set of rules, transformations, and/or protocols (e.g., which can be railroad authority specific or railroad authority agnostic). Movement authorities can be determined as a one-to-one mapping of authority grants from a railroad into a track map reference frame, and/or can be further constrained based on a set of rules/heuristics. For example, movement authorities and/or constraints associated therewith may be used to delineate between 'autonomous' sections of track and 'teleoperation' sections of track (e.g., restricted speed sections, where the authority is only granted under may only under a condition of remote supervision).

In variants, movement authorities can additionally include a set of operating constraints which can be received from the railroad authority and/or another endpoint (e.g., user interface, fleet management system), and/or can be retrieved from a track data system. For example, the operating constraints can include a speed-constraints (e.g., speed limit), directional constraint (e.g., unidirectional movement constraint, bidirectional movement constraint, etc.), track restrictions (e.g., teleoperation track segments, advisory bulletin restrictions, etc.), time constraints (e.g., expiration parameter associated with the movement authority, etc.), and/or any other suitable operational constraints. The railroad integration system can include processing and/or processing modules which can be: local, remote (e.g., at a remote server, at a third party server, cloud processing, etc.; an element of the remote systems), centralized, distributed, and/or processing for the railroad integration system can be otherwise executed. In variants, movement authorities can be updated by the railroad integration system periodically, aperiodically, in response to receipt of an updated authority grant from a railroad authority, and/or with any other suitable timing/frequency. Additionally or alternatively, movement authorities can be invariant/fixed until completed and/or vacated. In variants, movement authorities can be pushed to the motion planner, such as in response to movement authority issuance, and/or pulled from the motion planner (e.g., to facilitate motion planning, etc.).

However, movement authorities can be otherwise provided to the motion planner; and/or the system can include any other suitable railroad integration system and/or otherwise interface with railroad authority granting schemes/protocols.

3.1 Motion Planner

The system can optionally include and/or operate in conjunction with a motion planner 130 (a.k.a., 'vehicle dispatch system') which functions to direct traversal and/or dispatch a set of vehicles within the rail network. Additionally or alternatively, the motion planner can function to impose vehicle collision constraints and/or (macro-) authority constraints on vehicles within the rail network. Additionally or alternatively, motion planner functions to determine a set of exclusive reservations (a.k.a., 'micro-warrants' or 'track grants') which can be used to (granularly) direct vehicle operation throughout the rail network (e.g., under full autonomy, partial autonomy, remote supervision, teleoperation, etc.). Additionally or alternatively, the motion planner can function to maintain state awareness of vehicles throughout the rail network (e.g., with exclusive track reservations). For example, the motion planner can be as described in U.S. application Ser. No. 18/373,225, filed 26 Sep. 2023, titled "RAIL AUTHORITY SYSTEM AND/OR METHOD", U.S. application Ser. No. 18/499,034, filed 31 Oct. 2023, titled "RAIL CONTROL SYSTEM AND/OR METHOD", each of which is incorporated herein in its entirety by this reference.

The motion planner preferably receives the movement authority from the railroad integration service and/or otherwise determines a warrant(s) available for vehicle reservation, dispatch, and routing within a rail network. For example, the motion planner can receive a set of movement authorities from multiple railroad authorities to facilitate dispatch of vehicles across multiple railroads and/or rail yards within the network.

Based on the movement authority(ies), the motion planner can determine a motion plan(s) and/or issue track reservation(s) for each of the set of vehicles and/or vehicle controllers thereof operating within the rail network, thereby granting the vehicle(s) proceed authority within the track reservation(s). For example, the motion planner can dispatch vehicles by providing the track reservation to the vehicle and/or a command (e.g., motion plan) associated therewith, which directs/routes operation of the vehicle within the track reservation. Track reservations are preferably exclusive, with only a single vehicle assignment available for each reservation (e.g., which may provide a collision constraint, where the trains are positively controlled to remain within an exclusive track reservation). Additionally or alternatively, multiple vehicles coordinated within a platoon may operate independently within a singular reservation, and/or track reservations can be otherwise determined/assigned. For instance, wherein each vehicle of a platoon remains in continuous compressive contact, the platoon may be treated as a singular 'train' for the purpose of dispatch and/or routing. In a first example, the motion planner can determine a respective reservation for each train (and/or platoon) within the rail network. In a second example, the motion planner can determine a respective track reservation for a single vehicle within the rail network, such as a single electric vehicle/bogie as described in U.S. application Ser. No. 17/694,499, filed 14 Mar. 2022, and/or U.S. application Ser. No. 17/335,732, filed 1 Jun. 2021, each of which is incorporated herein in its entirety by this reference.

Track reservations preferably include a (granular) region of track, which can be a subset of the movement authority (e.g., 'micro-warrant'), a list of track segments referenced to map, track boundary constraints, and/or can be otherwise defined. Additionally or alternatively, track reservations can be otherwise defined in terms of Earth-frame coordinates (e.g., GPS coordinates), track coordinates, indexed track segments, and/or otherwise defined. Additionally or alternatively, track reservations can include or be associated with a set of operational parameters (e.g., target speed, speed limit, traversal direction; track rules; operational parameters of a command associated with the track region; etc.), a track condition parameter (e.g., checksum, validation parameter, etc.), and/or any other suitable parameters/information.

In some variants, the track reservations can include or be associated with a heartbeat parameter (or heartbeat mechanism/signal) and/or a command expiration parameter (e.g., a duration over which proceed authority is granted according to the command). For example, the reservation and/or command issuance itself may serve as a heartbeat mechanism, where the vehicle and/or a vehicle controller thereof is limited in its ability to autonomously/independently proceed by the (granular) authority grant of the reservation/micro-warrant. For instance, in the event of a communication failure and/or divergence in a track condition checksum for a track reservation (e.g., n+1 reservation issued to a particular vehicle), the vehicle may be limited to by the constraints of a prior (e.g., n) track reservation. In absence of communication between the motion planner and the vehicle controller, the motion planner may rely on the prior (e.g., n) track reservation and/or constraints thereof to maintain granular awareness of the location of the vehicle (e.g., which may facilitate persistent collision avoidance throughout the rail network and/or granular state estimation for the purpose to fleet management and vehicle command generation). Alternatively, the track reservations can include or be used in conjunction with a separate heartbeat parameter, which may be issued with the same timing/frequency as the track reservations or a different timing/frequency.

The motion planner can assign/issue track reservations and/or provide track reservations (a.k.a. 'micro-warrants' or 'track grants') and associated commands to vehicles (e.g., via wireless communication/broadcast, such as an LTE connection): periodically, aperiodically, in response to a command update (or change in a motion plan), in response to a track map update (e.g., change in track condition, issued bulletin, track geometry change, state change, etc.), in response to a track warrant update (e.g., based on and/or with any other suitable timing/frequency), in response to receipt of an updated vehicle state (e.g., from the vehicle controller), in conjunction with (and/or as an element of) a command or command signal, in response to remote teleoperator decision(s) (e.g., as in S140), and/or with any other suitable timing/frequency. More preferably, the motion planner can issue reservations with at least a (predetermined) minimum frequency (e.g., corresponding to a heartbeat parameter/signal). For example, commands and/or track reservation(s) associated therewith can function as a heartbeat signal and can be issued periodically (e.g., every 10 seconds, every 20 seconds, etc.). Additionally or alternatively, commands may correspond directly to an authority grant to (and/or assignment of) a track reservation.

The track reservations can include or correspond to a (granular) region of track and/or operational parameters of vehicle commands which direct vehicle routing and/or traversal within the rail network.

In one set of variants, the motion planner can determine vehicle commands based on a route (or 'motion plan') for the vehicle between an initial position (e.g., current/initial track coordinate; initial waypoint) and a destination (e.g., end track coordinate or waypoint) along a sequence of track segments. For instance, a motion plan may route a vehicle across junctions/switches (e.g., which may not be presently lined and/or which may be currently reserved), reserved regions of track (e.g., for which track reservations exist; which the vehicle may not presently occupy), restricted speed regions of track, and/or otherwise extends beyond the current constraints on the vehicle operation and/or current track reservation for the vehicle. As an example, the motion planner may determine a motion plan along an extant movement authority and repeatedly determine/issue commands to direct granular traversal of the vehicle based on the current constraints of the track (e.g., current reservations and local track rules, etc.). The commands and/or the track reservation therewith may govern proceed authority in accordance with the motion plan.

In a first example, a vehicle command can direct a vehicle in a particular direction between a starting and ending location (e.g., the distance between the starting location and ending location can be 50 miles in the case of main line operations or a 10 meter sequence of track spanning a gate or switch in the case of yard operations, etc.). In a second example, a vehicle command can direct a vehicle to traverse a particular distance down the track (e.g., corresponding to the reservation and heartbeat mechanism). In a third example, a vehicle command can be a navigational route (e.g., referenced/indexed against the track map). In a fourth example, vehicle commands can be waypoint-based commands. Vehicle commands can be predetermined (e.g., for a train running a fixed schedule), received from a fleet management system, manually determined by a human operator (e.g., commanding vehicle operation within a rail yard; determined and/or selected via the user interface), and/or otherwise determined. Commands can be assigned/directed to a particular vehicle and/or a vehicle identifier associated with a vehicle controller of the vehicle. For example, a command can be associated with a navigation and traversal of a train between an initial track coordinate and an end track coordinate. Alternatively, vehicle commands can be unassigned, undirected, vehicle indiscriminate, and/or can be any other suitable commands.

In variants, the motion planner can automatically determine and/or update motion plans and/or track reservations associated therewith based on: extant movement authority (ies) (e.g., received from the railroad integration system), existing track reservations (e.g., where track reservations may not overlap by rule), motion plans and/or vehicle commands (e.g., received from a fleet management system), the vehicle state (e.g., received from the vehicle controller to which the reservation will be granted/assigned), track conditions (e.g., received/retrieved track map data), the track reservation update frequency, other vehicles' states, platoon parameters (e.g., number of vehicles in a platoon, platoon weight, etc.), teleoperator inputs (e.g., via the remote operation platform 130; from S140) and/or any other suitable information. In a first example, the track region of a track reservation can be automatically determined contemporaneously and/or synchronously with (autonomous) operation/control of the respective vehicle (e.g., by the vehicle controller) to facilitate continuous and/or unencumbered operation of the respective vehicle under nominal conditions (e.g., absent emergent scenarios, absent proximal changes to track conditions, etc.). For instance, the motion planner can sequentially determine track reservations spanning adjacent portions of track which collectively grant the vehicle authority to maintain a substantially continuous speed (e.g., 30 mph; based on the vehicle command) while traversing a track region which exceeds the bounds of an initial reservation of the sequence. At the motion planner, motion plans and/or track reservations can be: calculated, looked up, determined using a set of heuristics, predicted (e.g., using a trained neural network), predetermined, randomly determined, manually determined, and/or otherwise determined by the motion planner. The track reservations generated from the same movement authority can have the same or different parameters (e.g., track region, duration, velocity permissions, etc.).

In some variants, the track region of a reservation can be dynamically determined (e.g., reservations can be dynamically sized in time and/or space), such as based on the operational constraints of a motion plan or command (e.g., a target speed and expiration parameter) and/or vehicle state (e.g., vehicle speed, maximum stopping distance under current conditions, etc.). In a first nonexclusive example, the size of the track region can be dynamically determined based on a target speed parameter (e.g., target vehicle speed, where the track region spans traversal of the current location of the vehicle and a traversal distance associated with vehicle traversal at target vehicle speed over a period of time, such as a warrant update cycle duration). In a second nonexclusive example, the track reservations can be dynamically sized based on a track geometry constraint(s) (e.g., where the warrant may terminate prior to a gate or switch, such as in cases where a rail switch state may not be verified/validated and/or where the switch is misaligned). In a third nonexclusive example, the track reservation(s) can be dynamically sized based on a user input and/or user command (e.g., where the vehicle may only be traversing a short section of track, etc.). In a fourth nonexclusive example, the track reservation(s) can be dynamically sized based on a geometry of a proximal reservation (e.g., where the reservations may not overlap, where the sets of track segments associated with each extant reservation are disjoint, where the reservations may be offset by at least a predetermined distance, which may impose collision constraints, etc.). In a fifth nonexclusive example, the track reservations can be dynamically determined based on (autonomous) vehicle performance constraints, such as a perception distance (e.g., how far ahead the vehicle is able to observe, such as based on terrain, track curvature, etc.), braking performance characteristics (e.g., minimum braking distance, etc.). In a sixth nonexclusive example, track reservations can be dynamically sized based on a known communication dead-zone (e.g., based on a map of communication dead-zones, such as may exist in rural settings, tunnels, etc.). For instance, a track reservation may be sized to span the entirety of a tunnel (e.g., where signal connectivity may be predictably absent until the vehicle traverses the tunnel).

In one variant, track reservations can be dynamically determined by: estimating a traversal distance along the track over the duration of the heartbeat (e.g., multiplying the current speed and/or maximum speed of the vehicle by the time length of a heartbeat period); determining maximum braking distance for the vehicle (e.g., from a lookup table, based on track requirements, estimated based on an estimated/target vehicle speed, etc.); and determining the track reservation as the region/track segments ahead the vehicle in a direction of traversal (e.g., along a navigation route), beginning from the current vehicle location and extending along a path length of at least the sum of the estimated traversal distance and the maximum braking distance. In a second variant, the track reservations can be determined as the track on the current location of the vehicle using a predetermined lookup table (e.g., based on vehicle speed and/or a target vehicle speed) and/or a predetermined set of rules/heuristics to determine the size/length of the track reservation ahead of the current location of the vehicle. Additionally, the region of the track reservation can be extended based on offsets in either direction, such as to accommodate: bidirectional traversal, a length of the vehicle, train, or platoon, communication latency (e.g., round trip and/or latency in either direction), braking distance offsets, predetermined offsets between vehicles (e.g., offset between the track reservation and an existing track reservation associated with another vehicle), perception-based offsets, switch clearance distances, and/or any other suitable offsets which may extend the track region of the track reservation in either direction. Additionally or alternatively, the forward end of the track reservation in the direction of traversal can be truncated—which may force the vehicle to slow—in order to command the vehicle to slow/stop based on various track features and/or track conditions (e.g., hazards, track obstructions, track geometry features, clearance points, grade crossings, intersections, work zones, SR/RS zones, mapped features, etc.). For example, the region can be truncated to terminate ahead of a grade crossing or a node in the track map geometry, such as when a switch state may prevent the vehicle from proceeding along a planned route. Alternatively, the region can span one or more mapped track features/conditions (e.g., where switch states are predetermined/known, where track features/conditions are addressed locally at the vehicle controller, etc.). Additionally, the track reservation can be truncated to prevent the track reservation from intersecting/overlapping an existing track reservation assignment associated with another vehicle/platoon (e.g., which may impose a collision constraint and/or avoid collisions between vehicles/platoons).

In some variants, the motion planner can determine/grant a single track reservation within a movement authority or a plurality of track reservations per movement authority (e.g., which may facilitate platoon formation, such as described in U.S. application Ser. No. 17/732,143, filed 28 Apr. 2022, which is incorporated herein in its entirety by this reference). Track reservation grants can be maintained indefinitely (e.g., while the vehicle occupies the corresponding region of track), can expire based on an expiration condition (e.g., in response to a determination of a superseding/replacement track reservation at a subsequent time, in response to satisfaction of an expiration condition associated with an expiration parameter, in response to vehicle egress from the corresponding track region, etc.), and/or can be otherwise managed. In a first example, a track reservation can be superseded by a subsequent track reservation associated with the same vehicle (e.g., vehicle controller and/or vehicle identifier). Alternatively, track reservations can remain active/valid until a vehicle vacates the track reservation (e.g., confirms operation under a subsequent track reservation and/or communicates a release the track reservation) and/or can be otherwise released/managed.

The motion planner preferably maintains exactly one active/valid reservation (a.k.a., micro-warrant) per vehicle, but can additionally or alternatively issue two active/valid reservation per vehicle (e.g., wherein the vehicle operates under exactly one track reservation; wherein the $n^{th}$ reservation is superseded by the $n+1^{th}$ reservation in response to a subsequent heartbeat confirmation, but both remain valid in absence of the heartbeat signal to accommodate asynchronous operation of the vehicle and motion planner), a plurality of reservations per vehicle (e.g., each corresponding to a respective expiration parameter), and/or any other suitable number of track reservations per vehicle and/or vehicle controller. In one example, a track reservation can be issued to the lead vehicle at a forward end of a platoon. In a second example, a track reservation can be communicated to a plurality of vehicle controllers within a platoon (e.g., at a lead vehicle of each car, each vehicle controller, etc.; where each vehicle controller is individually constrained to operate within the track reservation). In a third example, track reservations can be issued for the collective of vehicles within a platoon, but can additionally or alternatively be issued independently for each of a plurality of vehicles within the platoon (e.g., where each vehicle is individually limited by tighter constraints on the track reservation, such as based on a relative position along the length of the platoon). However, track reservations can be otherwise suitably granted.

The motion planner can include processing and/or processing modules which can be: local, remote (e.g., at a remote server, at a third party server, cloud processing, etc.), centralized, distributed, and/or processing for the motion planner can be otherwise executed. In a specific example, motion planning/dispatch can be regional and/or a set of regional motion planners can each govern track reservation issuance over a respective track region. In variants, the motion planner and the set of vehicles (and/or vehicle controllers thereof) within the network preferably operate contemporaneously and/or synchronously, where the motion planner can issue track reservations asynchronously to individual vehicles of the set (e.g., facilitating asynchronous state management of the vehicles within the network).

The motion planner preferably manages track reservations within a unified database/repository (e.g., maintaining redundancy and/or concurrency) and/or other data storage system. In a complete loss of power and/or communications at the motion planner (e.g., total power outage), the existing reservations remain, thereby maintaining belief state awareness and PTC throughout the network (i.e., no new reservations are issued, PTC maintained from prior belief state). For example, the motion planner may re-establish communication with each vehicle before issuing further reservations/commands.

In variants, the motion planner may optionally grant exceptions around regions of known poor signal connectivity. For instance, loss of GPS and external wireless communications may be predictable within a tunnel, where it is also less likely that the vehicle may encounter other hazards/trains (e.g., where greater access restrictions exist; due limited environmental access; etc.). Accordingly, the motion planner may adjust heartbeat parameters (e.g., length of timeout), track reservations, and/or otherwise facilitate traversal through regions of poor signal connectivity. For example, the motion planner may adjust track reservations based on a prior map of weak signal (and/or no-signal) connectivity (e.g., where latency and/or location accuracy falls below a predetermined threshold, where GPS is unavailable, etc.), such as may be predetermined based on prior communication data and/or tunnel locations. Alternatively, signal connectivity maps can be pulled from external databases, and/or otherwise determined/derived. In variants, signal connectivity exceptions may be granted based on specific rules (e.g., enabling a vehicle to traverse a tunnel or dead-zone; separate speed constraints; etc.), and/or can be otherwise implemented. Alternatively, vehicle authority grants may be separately issued for tunnels (e.g., locally) and/or signal connectivity exceptions may be otherwise handled. Additionally or alternatively, signal connectivity exceptions may be handled locally at the vehicle(s) (e.g., where stopping requirements may be temporarily suspended within a dead zone or weak-signal region, such as may exist in rural areas).

However, the system can include any other suitable motion planner and/or vehicle dispatch system.

In variants, the motion planner and/or reservation-based PTC provided by the motion planner can be persistent (e.g., in all modes of operation; for all vehicles, trains, and/or platoons within the rail network) and/or can be utilized during a subset of operational modes (e.g., full autonomy, supervised autonomy, etc.). Additionally or alternatively, where tele-op connection latency meets a minimum threshold, full tele-operation control by the remote operator platform (e.g., in response to a subset of remote operation requests) may be relied upon in some circumstances in-lieu of motion planner command.

3.2 Vehicles

The system can include or be used in conjunction with a set of vehicles which functions to collect perception inputs and execute vehicle commands. Additionally or alternatively, the vehicle(s) and/or vehicle controllers thereof can function to generate vehicle data, which can include sensor data (e.g., RGB image stream; point cloud; perception data; etc.), vehicle state data (e.g., vehicle trajectory, internal diagnostics, track position estimate, etc.), environmental representations (e.g., object detections, classifications, and/or tracking data; rail geometry estimates; annotated perception data; etc.), and/or any other suitable vehicle data.

Each vehicle can include a vehicle controller (e.g., autonomous vehicle controller) and a sensor suite. The vehicle(s) and/or vehicle controller thereof can be communicatively coupled to the remote infrastructure systems, such as the motion planner, remote operator platform, fleet management system, and/or remote data storage, via any suitable wireless data connection(s). For example, the vehicles can wirelessly broadcast vehicle data to a cloud data system (e.g., via RTSP), which can create an endpoint accessible to remote infrastructure. Remote data systems/servers can then rewrite the RTSP stream as WebRTC, which may allow operators to toggle between vehicle data streams in real-time (or near real-time) via the remote operator system. Additionally, vehicles can transmit (locally stored) vehicle data to remote infrastructure via any other suitable data connections (e.g., LAN, LTE data connection, cellular, Wi-Fi, Bluetooth, etc.), which may allow larger data volumes to be offloaded/stored when a high bandwidth connection exists, which can enable subsequent (asynchronous) analysis or supervised model training based on larger data volumes (e.g., via S160). Data (e.g., video streams, commands, etc.) can be transferred using WebRTC, RTMP, TRSP, HLS, SRT, CAMP, a combination thereof, and/or any other suitable data transfer protocol.

As an example, a WebRTC backend with selective forwarding units (e.g., an intermediary system, such as Janus) may facilitate communication between the vehicle, motion planner, and/or teleoperation system such that the teleoperation platform does not directly communicate with does not communicate directly with the vehicle (e.g., and/or video feed). For example, an intermediary behind the RTC application may facilitate high-bandwidth, multi-stream routing (e.g., particularly as the number of vehicles, video streams, and teleoperation endpoints is scaled), selectively forwarding data and/or video streams (e.g., from vehicles to the teleoperation system) as needed. Similarly, the teleoperation platform may be communicatively decoupled from the vehicle, and instead indirectly control the vehicle via the motion planner (e.g., which may further limit proceed authorization based on extant track reservations, track rules, etc.; which may periodically broadcast motion planning updates and/or commands to the vehicle[s] and verify communication integrity).

However, the vehicle can be otherwise suitably communicatively connected via any wireless network(s).

In variants, vehicle can include a sensor suite which functions to collect sensor data to facilitate traversal, remote monitoring, and/or remote assistance according to the method S100. The sensor suite can additionally function to monitor vehicle state parameters which can be used for vehicle control (e.g., autonomous vehicle control). The sensor suite can include: internal sensors (e.g., force sensors, accelerometers, gyroscopes, IMU, INS, temperature, voltage/current sensors, etc.), external antennas (e.g., GPS, cellular, Bluetooth, Wi-Fi, Near Field Communication, etc.), rail sensors (e.g., wheel encoders, cameras, temperature sensors, voltage/current sensors, accelerometers, etc.), payload sensors (e.g., force sensors/switches, cameras, lights, accelerometers, NFC sensors, etc.), environmental sensors (e.g., cameras, temperature, wind speed/direction, accelerometers), guidance sensors (e.g., load cells, bumper contact switches, strain sensors, lights, horn, sonar, lidar, radar, cameras, etc.), and/or any other suitable sensors. The sensors can include one or more: radar sensors, lidar sensors, sonar sensors, cameras, spatial sensors, location sensors, force sensors, on-board diagnostic sensors such as vehicle mechanism sensors, audio sensors, barometers, light sensors, temperature sensors, current sensors, air flow meters, voltmeters, contact sensors, proximity sensors, vibration sensors, ultrasound sensors, electrical sensors, and/or any other suitable sensors. However, the car can include any other suitable sensors.

In variants, one or more sensors of the sensor suite can be oriented towards the payload and arranged at a periphery of the car (e.g., corners, sides, front, rear, etc.), such as to enable wireless connectivity. In variants, vehicles include electrically decoupled sensor suites and/or powertrains, such as may be distributed between a pair of bogies of a car and/or multiple cars of a platoon. In such variants, the sensor suite can enable near field communication and/or wireless connectivity (e.g., V2V communication) between the train cars and/or bogies thereof.

The sensor suite preferably includes a set camera(s) at a fixed position (e.g., height) relative to the track. For example, the vehicle can include at least one forward facing camera which can provide a video feed for remote monitoring and/or proceed authorization. Additionally, the vehicle can include a rearward facing camera (e.g., which can be used to facilitate reversal and/or operation in an opposing direction), and/or can provide any other suitable sensor data to a remote monitor (e.g., speed, object detection/tracking annotations, etc.). As an example, teleoperators may toggle between video feeds (e.g., WebRTC streams) of multiple cameras on a vehicle and/or in a platoon.

However, the system can include any other suitable sensor suite.

The vehicle controller functions to control a vehicle within the rail network to facilitate operation of the vehicle based on the motion plan (and/or commands associated therewith) received from the motion planner and/or instructions from the remote operator (e.g., received directly or indirectly via the teleoperation platform). More preferably, the vehicle controller functions to facilitate autonomous operation of the vehicle within a track reservation (i.e., in which the vehicle is granted local autonomy/proceed authority), based on the constraints and/or operational parameters associated therewith. As an example, the vehicle controller may retain agency to stop based on vehicle state data, perceived surroundings, and/or internal diagnostics, but the movement/control of the vehicle controller may be directed and/or limited by the (dynamic) constraints of the reservation (e.g., teleoperation instructions/inputs from a remote operator and/or motion planner). For example, the vehicle commands may constrain/direct: maximum speed, maximum proceed distance (e.g., movement boundaries), autonomy level (e.g., full autonomy, partial autonomy, human-in-the-loop control, etc.), direction of operation (e.g., unidirectional operation, bidirectional operation, etc.), proceed capability through or past a track feature (e.g., manual validation/verification may be required to advance through a switch of unknown state, for example; relative to a clearance point and/or geocoordinate associated therewith), period of command validity (e.g., where the vehicle must stop in absence of a currently valid command) and/or can otherwise constrain/direct vehicle operation.

In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

Additionally or alternatively, the vehicle controller can facilitate Positive Train Control and/or otherwise operate as described in U.S. application Ser. No. 18/373,225, filed 26 Sep. 2023, titled "RAIL AUTHORITY SYSTEM AND/OR METHOD", U.S. application Ser. No. 18/499,034, filed 31 Oct. 2023, titled "RAIL CONTROL SYSTEM AND/OR METHOD", each of which is incorporated herein in its entirety by this reference.

The vehicle controller preferably determines a vehicle state and communicates the vehicle state to the vehicle dispatch system and/or remote data system (e.g., which can be used for validation, verification, and/or subsequent micro-warrant determination). The vehicle state determined by the vehicle controller can include: speed estimation, battery characteristics (e.g., state of charge, state of health, state of power, etc.), heading, diagnostic parameters (e.g., battery characteristics, powertrain characteristics, sensor characteristics, etc.), perception performance (e.g., heading distance, etc.), brake performance estimates (e.g., max stopping distance), environmental representations (e.g., classification of objects/obstacles in the environment), and/or any other suitable vehicle state parameters/estimates.

Additionally, the vehicle controller can provide loop closure by communicating (to the motion planner) confirmation of updates to reservation assignment (e.g., confirming operation under an n+1 reservation), switch position, track map updates (e.g., track condition parameter; via checksum), heartbeat parameters (e.g., central system connection parameters, warrant update parameters, etc.), and/or any other suitable information. In variants, if either the vehicle controller or the motion planner is unable to (asynchronously) validate communications and/or coordination relative to the track, the vehicle controller can control the vehicle to stop within the reservation.

In a first example, if the vehicle controller does not receive a heartbeat signal and/or an updated command/reservation (e.g., in the case of a communication failure, for example), the vehicle controller can stop the vehicle within the reserved region of track associated with a prior command (e.g., for which the vehicle has already received proceed authority). Similarly, if the motion planner is unable to validate the communications from the vehicle controller, the motion planner can directly control the vehicle to stop (e.g., via wireless communications) and/or indirectly control the vehicle to stop (e.g., restricting the vehicle by not issuing a superseding command/reservation which may be required for the vehicle to proceed).

Additionally or alternatively, the vehicle controller can function to distribute power and/or communications onboard the vehicle to affect (autonomous) vehicle control based on the motion plan and/or associated commands received from the motion planner.

The vehicle controller can additionally or alternatively function to implement autonomous navigation commands, teleoperation commands (e.g., received from a remote teleoperator), autonomous vehicle control (e.g., based on the set of operational parameters), and/or any other vehicle control based on the dispatch commands/instructions. The vehicle controller is preferably onboard the vehicle (e.g., mounted to a vehicle chassis, edge computing, etc.), but can additionally or alternatively be distributed at least partially remotely from the vehicle (e.g., where perception analysis is performed remotely in one or more operation modes, for example). The controller can be centralized (e.g., packaged within a single module) or distributed (e.g., across multiple compute nodes, packaged within multiple compute modules, etc.). The vehicle controller can receive sensory inputs/measurements from the sensor suite of the vehicle, which can be used to determine a vehicle state, generate environmental representations (e.g., detect objects in the environment, perform collision avoidance, etc.), dynamically control the vehicle, manage batteries, and/or control the (electric) powertrain. In variants, the vehicle controller can control a platoon of electric vehicle(s) individually and/or may be used to control vehicles in a pairwise manner (e.g., via V2V communications, etc.). In variants, a vehicle controller can include: a speed controller, velocity controller, PID controller, MPC controller, nonlinear controller, feedback controller, feedforward controller, and/or can implement any other suitable control schemes or any combination/permutation thereof. However, the system can include any other suitable vehicle controller and/or operate in conjunction with any other suitable vehicle(s) or vehicle control scheme(s).

However, the system can include any other suitable vehicle controller and/or operate in conjunction with any other suitable vehicle(s) or vehicle control scheme(s). Additionally or alternatively, the vehicle and/or motion planner can otherwise facilitate positive train control (PTC) via any suitable command/control paradigm.

The vehicle and/or controller thereof can be configured to transmit vehicle data to the motion planner and/or other external systems (e.g., remote data systems), which can include sensor data (e.g., camera image frames), vehicle state data (e.g., speed or velocity, localization data, etc.), timing data (e.g., GPS clock timestamp, etc.), perception data (e.g., annotated image frames; object detection/tracking data, etc.), and/or any other suitable data. Data can be offloaded with any suitable timing/frequency (e.g., event driven, periodically, based on operational mode, based on the track rules, etc.) and/or data format(s). In one set of variants, the vehicle can emit data and/or media via a WebRTC communication framework (e.g., which can facilitate in-browser web monitoring from a remote operator platform). As an example, each data frame emitted from the vehicle can include metadata such as: a timestamp and/or hashed timestamp (e.g., hashed with a specific vehicle key; timestamp with asymmetric encryption or another form of embedded cryptographic validation), vehicle state data (e.g., GPS location; linearized track position relative to a track map; etc.). However, the vehicle can transmit any other suitable data in any other suitable data format(s).

However, the system can include or be used in conjunction with any other suitable vehicle(s). In variants, the vehicles can be the rail vehicles as described in U.S. application Ser. No. 17/335,732, filed 1 Jun. 2021, U.S. application Ser. No. 17/694,499, filed 14 Mar. 2022, and/or U.S. application Ser. No. 17/732,143, filed 28 Apr. 2022, each of which is incorporated herein in its entirety by this reference.

3.3 Remote Data Systems

The system can include or be used with one or more remote data system which functions to: establish data connections between vehicle(s) and remote processing systems/modules (e.g., remote operator platform, vehicle dispatch, etc.), maintain track data to be used for dispatch and vehicle control (e.g., map data and/or map services), and/or store vehicle data (e.g., to be used for subsequent analysis/monitoring, via S140, and/or model training, via S150). The track data maintained within the track data system can include: waypoint database; a track geometry (e.g., including a map of track segments and nodes; versioned, such as with an instance identifier and/or timestamp associated with the most recent update; etc.), track features (e.g., track geometry, clearance points, grade crossings, switch states, signal states, bulletins, etc.), track conditions (e.g., work zones, SR/RS zones, etc.), and/or any other suitable track data. For example, the dispatch system, remote operator platform, and the vehicle controller(s) can each access track data (e.g., via a cloud service; etc.) for use in any suitable determination/control determinations. Track data can be pushed to various endpoints (e.g., by a data service/system) and/or pulled from the track data system (e.g., by the motion planner, remote operator platform, and/or vehicle controller) with any suitable timing/frequency.

In variants, track data can be managed and/or maintained as described in any one or more of: U.S. application Ser. No. 18/373,225, filed 26 Sep. 2023, U.S. application Ser. No. 18/499,034, filed 31 Oct. 2023, U.S. application Ser. No. 17/335,732, filed 1 Jun. 2021, U.S. application Ser. No. 17/694,499, filed 14 Mar. 2022, and/or U.S. application Ser. No. 17/732,143, filed 28 Apr. 2022, each of which is incorporated herein in its entirety by this reference.

3.4 Remote Operator Platform

The remote operator platform 120 (a.k.a., tele-operation interface or tele-operation user interface [UI]) functions to facilitate manual command of vehicles, remote monitoring of rail infrastructure, manual updates to track map data (e.g., manual determinations of switch state for unmonitored switches, etc.), manual exception handling by a remote operator, and/or other vehicle assistance by a remote operator. Additionally or alternatively, the user interface can function to facilitate responses to remote operation events via Block S150.

The remote operator platform can be communicatively connected to the vehicle via a wireless data connection (e.g., LAN, LTE, WebRTC, etc.) and/or can receive real-time data streamed from the vehicle (e.g., RTSP converted to WebRTC). Additionally, the remote operator platform may access stored vehicle data, historical vehicle data (e.g., associated with outstanding/queued operation requests), and/or any other suitable prior data generated by vehicle systems. Additionally, the remote operator platform can access from remote data systems with any suitable timing/frequency (e.g., based on a pull request, operator request, etc.).

In a first set of variants, the remote operator platform can include a computing system, a display, a set of input devices, and/or any other suitable hardware components. The computing system functions to enable the communication and data processing to facilitate remote monitoring and/or tele-operation by way of the set of input devices and display. The remote operator platform and/or computing system thereof are preferably remote (relative to the vehicle), and can be communicatively coupled to the vehicle and/or motion planner via any suitable communication channels and/or protocols. For example, the remote operator platform can be coupled to the vehicle via an API (e.g., within a WebRTC framework), and communicatively coupled to the motion planner (e.g., by a separate API, integrated within a remote computing system/network, etc.). However, the remote operator platform can include any other suitable hardware/infrastructure components and/or can otherwise interface with any other suitable hardware devices (e.g., authorized user device/tablet executing a Web application, etc.). However, the remote operator platform can be otherwise configured, and/or various elements of the remote operator platform may alternatively be a standalone, decoupled web application or web service (e.g., managed by a third-party, etc.; where queued remote operation requests are provided to an remote/external train engineer, etc.).

The set of input devices can function to facilitate verifications and/or decisions by a remote (tele-) operator (e.g., actively, passively) and/or any other suitable operator inputs (e.g., issuance of a proceed command to move past a potential hazard; semantic object label; state/position determination for a track feature; etc.). The set of input devices can be wired, wireless, separate from the display (e.g., keyboard mouse, joystick, inceptor, etc.), integrated with a touchscreen display, and/or can be otherwise implemented. In a specific example, the set of input devices can include a low-latency, wired mouse (e.g., performance gaming mouse; high sensitivity/DPI; <1 ms input lag). The set of input devices can include binary input mechanisms (e.g., push buttons, point-and-click, etc.; emergency stop button), analog inputs (e.g., scroll wheels, sliders, etc.; which may facilitate highly/infinitely variable continuum of inputs), touchscreen inputs, and/or any other suitable input mechanisms. However, the remote operator platform can include any other suitable input devices.

The remote operator platform can include a display, which functions to display image frames (and/or a real-time video feed) from the vehicle to a remote tele-operator to facilitate vehicle monitoring and/or command validation. Additionally, the remote operator platform (and/or display thereof) can continuously and/or selectively display frame metadata (e.g., communication latency[ies], data timestamp, etc.), vehicle state data (e.g., speed, battery state of charge, location relative to a track map, obstacle detection/tracking data, etc.), command information (e.g., proceed authorization relative to track map; track-relative position and/or GPS location of vehicle; target destination; etc.), and/or any other suitable parameters.

In variants, the set of input devices can include redundant power and/or data connections, and/or may continuously/periodically monitor connection integrity. For example, the remote operator platform can optionally include interlocks devices and/or hardware validation systems/functionalities which can validate that the user input mechanism(s) are operational (i.e., that a user monitoring the vehicle is able to stop the vehicle or otherwise intervene to appropriately adjust commands to emergent events). However, the input devices can alternatively be redundant, rely on backup (battery) power sources, and/or can be otherwise configured.

In one example, the tele-operator controls may be locked in response to a determination of a hardware failure, and the remote operator platform can automatically issue a stop command (and/or passively restrict future proceed authorization until control functionality is restored). Additionally or alternatively, in the event that a connection is interrupted at any portion of the round trip communication between the vehicle and the remote operator platform (and/or locally at an input device of the remote operator platform), the vehicle may be required to stop (e.g., passively, based on the heartbeat mechanism provided by the motion planner, etc.).

However, the remote operator platform can otherwise facilitate remote vehicle monitoring and/or can be otherwise suitably implemented.

In variants, remote operator intervention via the remote operator platform is preferably requested (e.g., push request) by the vehicle and/or motion planner based on the location of the vehicle (i.e., track rules for the current location of the vehicle) and/or vehicle state (e.g., detected potential hazard) in response to satisfaction of a trigger condition or event. For instance, the remote operator may monitor the vehicle as it proceeds through a restricted speed region of track and/or may monitor the vehicle as it traverses past a potential hazard. The remote operator may retain command authority until the vehicle has exited a restricted speed region and/or until the remote operator releases command authority. For example, the remote operator platform may facilitate transitions from a remote monitor operation mode to an unmonitored PTC mode (e.g., fully autonomous) in response to an input from a remote operator via the set of input devices.

However, the system can include any other suitable remote operator platform.

The system can optionally include or be used with a fleet management system 104 which functions to determine vehicle commands and/or direct fleet resources (e.g., vehicles, cargo, etc.; human resources, such as tele-operators) to facilitate vehicle operation throughout the vehicle network.

In some variants, the fleet management system can additionally or alternatively prioritize tele-operation requests and/or direct tele-operation resources in accordance with Block S120.

In some variants, the fleet management system can determine a vehicle to dispatch for a particular vehicle command and/or motion plan, such as a set of rules, heuristics, decision logic (e.g., a decision tree, etc.), a neural network (e.g., weighted linear regression), and/or can otherwise select a vehicle for dispatch. For example, vehicles can be selected based on availability (e.g., not loaded with cargo), proximity to a target (e.g., distance, traversal time, number of intervening vehicles, estimated time of arrival [ETA], etc.), vehicle state, state of charge, state of maintenance, and/or can be otherwise selected. Additionally or alternatively, commands and/or motion plans can be manually associated with a particular vehicle (e.g., via UI inputs; where a user directs a particular vehicle to move to a particular location via the UI, for example). Additionally or alternatively, the fleet management system can determine vehicle commands based on routing and/or navigational optimizations (e.g., based on the track information and extant authority grants, etc.) for the fleet of vehicles within the rail network, and communicate the vehicle commands to the dispatch system for granular execution (e.g., micro-warrant determination/assignment).

However, the system can include or be used with any other fleet management system and/or can exclude a fleet management system.

However, the system can include any other suitable components.

3. Method

The method S100, an example of which is shown in FIG. 3, can include: determining a remote operation request Silo; optionally determining a priority of the remote operation request S120; providing vehicle data to a remote operator S130; responding to the remote operation request S140; and optionally training a model based on the response S150. However, the method S100 can additionally or alternatively include any other suitable elements. The method S100 functions to facilitate remote assistance of a vehicle operating within a rail network (e.g., operation of unmanned vehicles within restricted track regions). Additionally or alternatively, the system can function to facilitate remote validation/verification of vehicle operations and/or rail infrastructure status.

Figure 6:
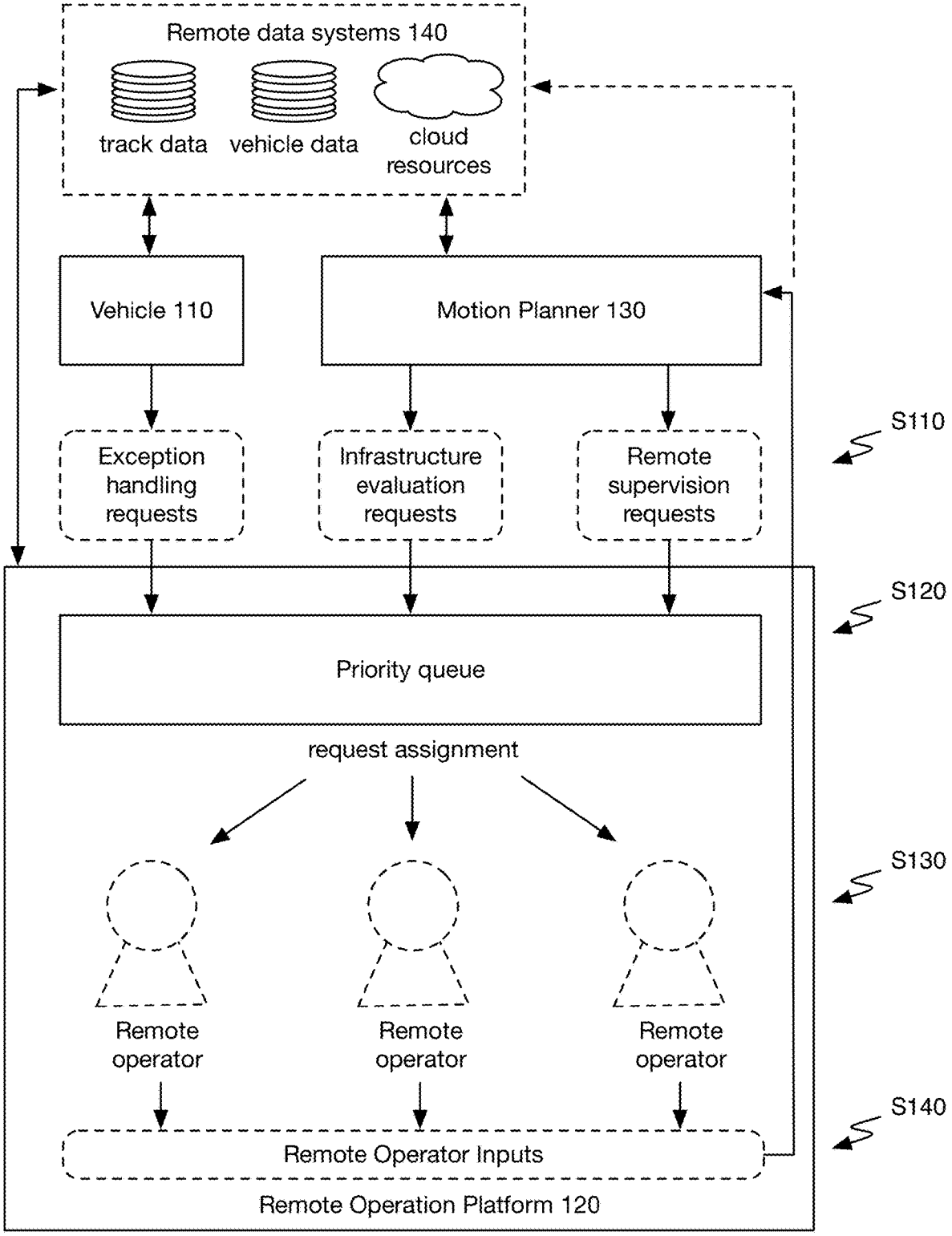
FIG. 6 is a schematic representation of a variant of the system and/or method.

Determining a remote operation request S110 functions to initiate a request for involvement of a remote operator to assist and/or monitor vehicle operation. A remote operation request can be determined and/or initiated: onboard the vehicle, by a vehicle controller, and/or offboard the vehicle, by a remote system (e.g., such as the fleet management system and/or motion planner). The request can be determined based on: track information (e.g., track conditions/constraints), vehicle data (e.g., vehicle state), authority grants (e.g., current issued warrants, etc.), and/or any other suitable information. Requests can be determined automatically, manually, periodically, in response to satisfaction of a trigger event, during vehicle traversal (e.g., during a transit trip and/or while a vehicle is proceeding along a section of track; contemporaneously with autonomously controlling the rail vehicle according to a motion plan), prior to vehicle traversal (e.g., while the vehicle is stationary/stopped, prior to vehicle traversal of a particular section of track, etc.), and/or with any other suitable frequency/timing. In one variant (e.g., an example is shown in FIG. 6, three types of remote interventions may be requested during Silo: remote evaluation of an exception occurrence (e.g., autonomous detection of a hazard by the vehicle controller; vehicle exception), remote evaluation of track infrastructure (e.g., status of a track feature, such as a switch target or a railroad derailer), and remote supervision and/or control of a vehicle through a restricted track region (e.g., a restricted speed region; based on the track rules).

Remote operation requests can be determined based on track rules (e.g., based on a periodic trigger or track rule to evaluate a particular piece of infrastructure; such as a track feature), autonomy exceptions, environmental conditions, manual (user) requests (e.g., by an operator), prospectively (e.g., prior to vehicle slowdown at a hazard, track feature, or restricted speed zone), reactively (e.g., triggered in response to an autonomy exception; in response to detection of a potential hazard), and/or based on any other suitable conditions/factors. Remote operation requests are preferably determined contemporaneously with (autonomous) vehicle operation, but can additionally or alternatively be determined in response to a motion plan update (e.g., route adjustment), in response to a user request and/or with any other suitable timing/frequency.

In a first variant, a remote operation request can be determined onboard the vehicle, by a vehicle controller, based on a vehicle state estimate. For example, the vehicle controller can initiate a remote operation request based on perception performance (e.g., where the vehicle perception performance satisfies a predetermined trigger condition; where a heading distance falls below a threshold, such as the minimum braking distance in the instantaneous vehicle state; etc.), based on an environmental representation or environmental awareness (e.g., where a classification probability and/or perception confidence falls below a predetermined threshold; etc.), based on internal diagnostics, and/or in response to any other exception occurrence in the vehicle state.

In a second variant, a remote operation request can be determined offboard the vehicle, such as by a motion planner (a.k.a., vehicle dispatch system; and/or a fleet management system), based on the motion plan and/or track data (i.e., track rules). For example, prior to routing/dispatch of an unmanned (e.g., semi-autonomous or fully autonomous) vehicle into a restricted speed zone of a track (e.g., where a train engineer verification of rail equipment operability may facilitate satisfaction of regulatory compliance), motion planner may initiate a request for remote operation/monitoring of the vehicle. In a second example, fleet management and/or motion planning can additionally initiate remote operation/monitoring requests for operators to determine a status of rail infrastructure/equipment (e.g., periodically, to persistently maintain awareness of track information and/or track geometry, in response to a vehicle crossing a piece of rail infrastructure, prior to a vehicle approaching the rail infrastructure, etc.).

In a third variant, remote operation requests can be manually determined (e.g., offboard the vehicle at the remote operator platform, by a human track worker or service technician with line-of-sight to the vehicle, etc.). For example, a remote user monitoring a plurality of vehicles simultaneously via the remote operator platform can initiate a manual request, based on the vehicle data or perception stream from an individual vehicle of the plurality, for direct involvement of an (additional) operator to operate the individual vehicle/train. Alternatively, human workers (e.g., yard workers, terminal workers, maintenance of way workers; etc.) may manually provide remote operations requests via a dedicated user interface, API, and/or push request.

However, remote operation requests can be otherwise initiated.

Optionally determining a priority of the remote operation request S120 functions to prioritize remote operation requests and facilitate queuing of requests. Additionally or alternatively, S120 can enable assistance of multiple rail vehicles/trains, which are contemporaneously in transit, by a single remote operator (e.g., at the remote operator platform), and can enable the system to efficiently distribute remote operation resources amongst a plurality of vehicles operating within the network. For example, remote operation request can be ranked/ordered in a queue on the basis of priority (e.g., a priority score), determined based on: train size (e.g., length, mass, number of cars, etc.), cargo value, state of charge, scheduling parameters (e.g., fleet management parameters, critical path parameter, future scheduling parameters, temporal parameters), throughput on route/track section, temporal parameters (e.g., time remaining until the vehicle must stop until remote assistance is available; estimated time of arrival [ETA] to a transition point; etc.), vehicle health, proximity to a transition point/node, and/or any other suitable priority parameters/considerations. Remote operation requests can be queued with any suitable prioritization scheme or selection criteria, such as: heuristics, rule-based scoring, decision trees, weighted linear regression, (rudimentary) weighted neural networks, energy maximization or cost minimization functions, and/or any other suitable prioritization techniques/processes.

In a specific example, estimated time of arrival [ETA] can be used to evaluate vehicle proximity to a "Teleops Required" section of track (e.g., yard limits) for the priority queue, which may provide the benefit of reducing the latency of a Teleops transition while on the "Main Track," where the Main Track can be a chiefly important asset for the railroad.

In variants, changes in motion planning and/or vehicle dispatch (e.g., new warrant issuance) and/or vehicle proceed capability (e.g., allowing the vehicle to progress along the track) may be gated (e.g., at a junction or restricted speed zone; based on operational constraints; protected with a derail; etc.), until the remote operation request is handled by a remote operator in S150. In such variants, priority queuing can allow human operators to be queued for a supervision/assistance of a vehicle before the train/vehicle is required to stop, thus mitigating potential downtime from the vehicle stopping along the rail, which may propagate scheduling issues throughout the network and/or impact overall network efficiency. Additionally, variants can enable remote operations requests to be queued and/or assigned to a remote operator prior to a dispatched vehicle reaching a restricted speed zone, which may allow the vehicle to enter the restricted speed zone (e.g., based on the motion plan) without modifying/delaying the vehicle route/trajectory.

Accordingly, where multiple remote operations requests (e.g., object hazards and/or track feature status determinations) may require remote intervention at variable distances along the track and/or temporal urgency (e.g., for critical path operation of the rail network), the priority queue may triage emergent issues and assign a remote operator(s) to intervene based on the priority.

In variants, multiple remote operations requests can be queued for a single vehicle (and/or train/platoon). For example, a remote operator may be relied upon to render decisions on multiple autonomy exceptions (e.g., multiple potential hazards detected by the vehicle[s] along the track)

at different positions along the track. In such cases, the operations requests can be prioritized/queued based on distance along the track (i.e., potential hazards nearer to the train may be prioritized in the queue and handled first). Similarly, multiple remote operations requests can be queued for track features, whose state may need to be observed to satisfy track rules (e.g., in order for the vehicle to proceed and/or release a reservation/warrant for a section of track). In a first example, multiple track features remote operations requests can be queued ahead of the vehicle/train for a particular motion plan (e.g., where an operator decision must be rendered to proceed past the track feature).

However, the system and/or method can alternatively be used without priority queuing in some variants/contexts, and/or remote operation requests can be otherwise prioritized/queued. For example, remote (tele-)operators can alternatively monitor each individual train/vehicle without prioritization/queuing, and/or prioritization/queuing may be limited in cases where sufficient (variable) operator bandwidth exists.

Prioritization/queuing may occur once, periodically, recurrently, in response to receipt of an additional remote operation request (e.g., by S110), in response to assignment/selection of a teleoperator for a remote operation request (e.g., by S130), and/or with any other suitable timing frequency.

Providing vehicle data to a remote operator S130 functions to facilitate remote monitoring and assistance of vehicles operating within the rail network. Additionally, S130 can function to assign operators to respond to remote operation requests in accordance with Block S140. Vehicle data can include sensor data (e.g., RGB image stream; point cloud; perception data; etc.), vehicle state data (e.g., vehicle trajectory, internal diagnostics, track position estimate, etc.), environmental representations (e.g., object detections, classifications, and/or tracking data; rail geometry estimates; annotated perception data; etc.), and/or any other suitable vehicle data. Vehicle data is preferably generated locally onboard the vehicle at the vehicle controller, but can additionally be further processed/analyzed by remote data systems (e.g., cloud processing).

Vehicle data is preferably transmitted/broadcast from the vehicle to the remote data system(s) and/or vehicle dispatch system via a wireless data connection (e.g., LTE, satellite, cellular, etc.). Vehicle data can be transmitted (and stored) once, repeatedly, periodically, substantially continuously (e.g., periodically with a frequency of greater than 10 Hz, during transit), in response to a determination of a remote operations request onboard the vehicle, and/or with any other suitable timing/frequency. Vehicle data can be provided to remote vehicle operators at the remote operator platform in substantially real time and/or can be retrieved from stored data (e.g., pulled from historical vehicle data stored at the data system). In a first variant, the vehicle(s) can wirelessly broadcast vehicle data to the data system (e.g., via RTSP; cloud data system), which can create an endpoint accessible to remote systems such as the remote operator platform and/or vehicle dispatch. The data systems/servers can then rewrite the RTSP stream as WebRTC, which may allow operators to toggle between vehicle data streams in real-time (or near real-time) via the remote operator system. In a specific example, operators may toggle between and/or concurrently view data streams associated with both ends (e.g., front and rear) of a vehicle, which may expedite direction changes (e.g., switching between traversal in a first direction to traversal in an opposing direction) and/or vehicle reversal, when directed/supervised by the operator.

Vehicle data can be provided along with a remote operation request and/or can be retrieved/accessed in association with a remote operation request. For example, a vehicle passing a junction can trigger a remote operation request for a remote operator to evaluate the status of the junction and/or a switch. A corresponding set of image frames (or an index/reference associated with a set of image frames) can be provided along with the request, which can be subsequently analyzed via the remote operator platform (e.g., when it reaches the top of the priority queue). Alternatively, a remote operation request can be associated with live assistance/tele-operator of a particular vehicle/train, wherein the live vehicle data associated with the train is provided/accessed in (substantially) real time during S130 (and/or S140).

Vehicle data is preferably provided in S130 based on the priority queue, with the highest priority requests being assigned to operators which are available on the remote operation platform. In some variants, the remote operation platform can be distributed (e.g., with operators located in various geographic areas), where operators can additionally be assigned based on geographic proximity to the vehicle associated with a (live) dispatch request, connection latency parameters, and/or any other factors which influence wireless signal/connection integrity. In one example, a remote operator (and/or a respective endpoint of the teleoperation platform) be selected based on availability and video stream latency at the respective platform. For instance, the remote operator can be selected based on a minimum round-trip latency requirement for Positive Train Control (PTC) (e.g., where the heartbeat signal and/or proceed authorization facilitates operation for some time period after the timestamp of a monitored video frame, the each command packet must be received by the vehicle command before the expiration of the command packet in order for the vehicle to proceed). As a result, a remote operator and/or teleoperator platform can be selected based on the parameters of the heartbeat signal and/or based on satisfaction of a minimum latency threshold (e.g., 50 ms, 100 ms, 200 ms, 300 ms, 500 ms, 700 ms, 1000 ms, any open or closed range bounded by the aforementioned values, and/or any other suitable minimum latency; where interrupted and/or high latency connections may be redistributed to another teleoperator).

In variants, remote operation requests can optionally be assigned and/or provided to operators based on an attribute-based filter (e.g., experience level, average response time, etc.) and/or a qualification-based filter (e.g., certification level; etc.). For example, remote operation requests can be associated with a set of minimum operator qualifications (e.g., according to track rules), wherein queuing the remote operation request comprises: assigning the remote operator to complete the remote operation request based on the priority and the set of minimum operator qualifications.

Vehicle data can be provided to a remote operator (who is selected or assigned to assist the vehicle) via the remote operator platform: once, periodically (e.g., based on a data update frequency, such as about 10-30 Hz), substantially continuously (e.g., while the operator is the responsible party; during a remote supervisory period, such as while proceeding through a restricted speed region of track; until the operator renders a decision and/or releases command authority, etc.), during a portion of vehicle traversal/transit (e.g., discrete sections of traversal), and/or with any other suitable timing. In a specific example, vehicle data may be provided to a remote operator to assist or monitor a vehicle during a fraction of a substantially autonomous vehicle trip, such as during portions of the vehicle trip when the vehicle traverses a crossing(s), a switch(es), a signal(s), a restricted speed region(s), a spur(s), and/or a track region(s) associated with a track bulletin notice (e.g., which constrains autonomous operation). More preferably, the prioritization/queuing of remote operations requests may allow for preemptive and/or just-in-time assignment of a remote operator to supervise traversal through restricted speed regions and/or supervised crossings (i.e., where supervision may be scheduled, planned, and/or prioritized based on the motion plan), which may avoid the need to stop and/or wait for teleoperator supervision to proceed through clearance points.

Operator assignment and/or selection preferably occurs automatically (e.g., as a backend service; at a distributed/cloud computing system), such as in response to an operator indicating an available status (e.g., selection/assignment can be based on operator availability) and/or resolving a prior operation request (e.g., releasing teleoperation supervision/control of another rail vehicle), but can additionally or alternatively be based on scheduled/pre-planned (e.g., based on future availability and/or queue prioritization), and/or can occur with any other suitable timing/frequency.

However, vehicle data can be otherwise provided via the remote operation platform and/or operators can be otherwise assigned to assist/monitor vehicles operating within the network.

In variants, observation/evaluation of switch indicator flags (a.k.a., switch targets; for which an operator may be requested to verify that the trailing points of the switch are in agreement with the flag) and/or derails (a.k.a., derailers; which may need to be observed/verified by an operator under certain conditions) may drive video feed resolution requirements of S130 (and/or max observation/proceed distance). However, in some variants, S130 can optionally include providing a zoomed image region for the at least one frame of the video feed (e.g., based on the estimated feature position; wherein the vehicle data comprises an estimated position of the track feature within the at least one frame). For instance, the image may be selectively enhanced/zoomed by the operator (e.g., in response to a manual request) and/or a digital or synthetic zoom may be provided around one or more estimated track feature positions.

Responding to the remote operation request S140 functions to facilitate remote supervision and/or assistance of vehicle operation. Additionally or alternatively, S140 can function to update track data based on status decisions by a remote operator. S140 is preferably performed at the remote operator platform and/or based on (manual) operator decisions received via the remote operator platform based on the vehicle data provided in S130. Operator inputs received via the remote operator platform can include: direct vehicle controls (e.g., throttle/braking commands, velocity commands, etc.), vehicle commands (e.g., navigational instructions, waypoint-based controls, etc.), binary proceed decisions (e.g., proceed/stop), and/or any other suitable navigational/control decisions. Additionally or alternatively, responses received via the remote operator platform can include: passive approval/proceed authority (e.g., where an active input from a remote operator may only be necessary in order to modify an existing route or navigational plan), environmental classifications, track information, status updates, authority/responsibility transfers (e.g., releasing command authority back to the vehicle after an intervention), and/or any other suitable information.

S140 can occur in response to S130, concurrently with S130 (e.g., while a remote operator monitors a real time data stream), automatically in response to receipt of operator decisions/inputs received via the remote operator platform, and/or with any other suitable timing/frequency.

In a first variant, S140 can include controlling the vehicle based on remote operational decisions which are directly communicated to the vehicle (e.g., via a real-time data connection) from the remote operator platform. For example, the remote operator can tele-operate the vehicle based on a real-time data stream provided in S130 (e.g., until the vehicle departs a restricted speed region of track; until the remote operator assigned to the vehicle releases command authority, etc.).

In a second variant, S140 can include updating a motion plan based on remote operational decisions provided to the motion planner, which can indirectly implement the vehicle commands (e.g., issuing track reservation and/or proceed authorization, where the vehicle retains autonomous decision making within a track reservation). For example, at the teleoperation platform, a remote operator may grant proceed authorization (e.g., passively, actively, etc.) for a rail vehicle along an observable portion of track based on the vehicle data (e.g., an observable portion of a video feed, as designated by the remote operator and/or provided as an input via the teleoperation system, etc.), where the rail vehicle may proceed (e.g., autonomously) according to the motion plan within the observable portion of track. For instance, the teleoperator may supervise autonomous operation of the rail vehicle within a restricted speed track region (e.g., actively or passively granting proceed authorization in S140, where teleop proceed authoritization over the observable portion of track may allow track reservations to be provided over the observable portion of track).

In a third variant, S140 can include updating track information based on the remote operation decisions. As an example, remote operation decisions may not be communicated to the vehicle, such as in cases where the operational decisions pertain to track information which is no longer relevant to the vehicle, such as a status of an adjacent/trailing track infrastructure component (e.g., switch state). However, infrastructure status may be used for fleet management, routing, and dispatching of other vehicles operating within the rail network.

S140 can optionally include receiving and/or storing remote classifications of the environment received via the remote operator platform such as: a semantic label or classification assigned to an object instance ID in the vehicle environment (e.g., stroller, boulder, cardboard box, pedestrian, etc.; static object, dynamic object, etc.). For example, in the event that the vehicle pushes a remote operation request based on onboard perception and/or environmental classification, a remote operator can verify or update object classifications and indicate how the vehicle should respond (e.g., stop and wait, proceed, reroute, etc.). Semantic labels/classifications can be stored and/or used to train/update models in conjunction with S150.

However, any other suitable responses/actions can occur in response to the remote operation request and/or vehicle data provision; and/or vehicle operators may otherwise assist vehicle operation.

In variants, the method can optionally include training a model based on the response S150, which functions to facilitate supervised learning based on the responses to remote operation requests and/or feedback from the remote operators. As an example, data aggregated from operator inputs and associated vehicle commands can be used to train/update machine-learning (ML) models and/or computer-vision (CV) based perception, navigation, and control systems. Operator inputs/feedback can be used to seed key events or object observance relative to time/distance traveled, in order to reduce redundancy in training data (e.g., flagging key events; etc.). Alternatively, models can be trained with vehicle data from separate portions of the traversal and/or remote operation data may not be utilized for model training.

However, the method S100 can include any other suitable elements.

In some variants, special/remote handling can be triggered by satisfaction of a 'virtual tripwire' associated with a special handling region of track (e.g., restricted speed zone), a route evaluation function that interrogates the next N-meters of track for special handling, and/or another heuristic or model.

In some variants, external behavior requests, such as designated a restricted speed (e.g., Teleoperation) zone, can be injected by sending Temporal Track modifiers over an Application Program Interface (API) which also encompasses the internal translation of Track Bulletins (e.g., between a motion planner and other remote systems, such as the remote operator platform, railroad integration system, etc.).

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A system for remote assistance of a rail vehicle operating within a rail network, the system comprising:

a motion planner communicatively coupled to the rail vehicle and configured to:

determine a motion plan for a rail vehicle which is configured to autonomously operate according to the motion plan; and contemporaneously with autonomous operation of the rail vehicle, determine a set of remote operations comprising a first remote supervision task for the rail vehicle;

a teleoperation platform configured to at least partially command the rail vehicle based on inputs from a remote operator; and a fleet management system configured to:

determine a priority queue for the set of remote operations; and respond to the first remote supervision task based on the priority queue, comprising: triggering provision of vehicle data from the rail vehicle to the teleoperation platform.

2. The system of claim 1, wherein the motion planner comprises a first computing system which is offboard the rail vehicle, wherein autonomous operation of the rail vehicle according to the motion plan comprises: maintaining Positive Train Control (PTC) by periodically broadcasting commands from the first computing system to the rail vehicle.

3. The system of claim 2, wherein, for a track region associated with the first remote supervision task, the commands depend on the inputs from the remote operator; wherein the track region is defined relative to a track geometry of the rail network.

4. The system of claim 1, wherein the motion planner is configured to command the rail vehicle based on the motion plan and a proceed authorization received from the teleoperation platform, responsive to the first remote supervision task.

5. The system of claim 1, wherein the priority queue is based on respective motion plans for a plurality of rail vehicles traversing within the rail network.

6. The system of claim 1, wherein the first remote supervision task is determined based on the motion plan and a set of track rules, wherein at least partially commanding the rail vehicle via the teleoperator platform comprises determining proceed authorization for the rail vehicle within a restricted speed track region.

7. The system of claim 6, wherein proceed authorization for the rail vehicle is granted along an observable portion of the restricted speed track region based on the vehicle data, wherein the rail vehicle is autonomously controlled, according to the motion plan, within the observable portion of the restricted speed track region.

8. The system of claim 1, wherein the vehicle data is selectively forwarded from an intermediate application to the teleoperation platform, wherein the at least partially command of the rail vehicle via the teleoperation platform comprises sending operator instructions to the motion planner.

9. The system of claim 8, wherein the video stream comprises a timestamped WebRTC stream.

10. The system of claim 9, wherein the remote supervision task is assigned to the remote operator based on a minimum round-trip latency requirement for Positive Train Control (PTC).

11. The system of claim 1, wherein the fleet management system comprises a cloud computing service.

12. The system of claim 1, wherein the teleoperation platform is communicatively decoupled from the rail vehicle and is configured to indirectly command the vehicle via the motion planner.

13. The system of claim 1, wherein, at the fleet management system, the remote supervision task is queued along with a first set, second set, and third set of remote operation requests for the rail network, each operation request of the first set determined by an autonomous rail vehicle based on an exception occurrence, each operation request of the second set determined based on satisfaction of a trigger condition associated with rail vehicle proximity to a track feature of the rail network, each operation request of the third set determined based on a respective motion plan.

14. The system of claim 1, wherein the rail vehicle comprises a lead vehicle of a rail platoon, wherein the vehicle data provided to the remote operator comprises independent video streams of distinct rail vehicles within the rail platoon.

15. The system of claim 14, wherein the teleoperation platform is configured to selectively toggle between the independent video streams of the distinct rail vehicles within the rail platoon.

16. A system comprising:

a motion planner communicatively coupled to a rail vehicle and configured to:

determine a motion plan for a rail vehicle, the rail vehicle configured to autonomously operate according to the motion plan; and contemporaneously with autonomous operation of the rail vehicle, determine a remote operation request based on the motion plan;

a teleoperation platform configured to:

determine an operator assignment for the remote operation based on a priority queue;

receive vehicle data collected by the rail vehicle, wherein the vehicle data is selectively forwarded from an intermediary application to the teleoperation platform based on the operator assignment;

determine a set of remote operator inputs based on the vehicle data; and provide the set of remote operator inputs to the motion planner for command of the rail vehicle.

17. The system of claim 16, wherein the motion planner comprises a computing system which is offboard the rail vehicle, wherein autonomous operation of the rail vehicle according to the motion plan comprises Positive Train Control (PTC) of the rail vehicle based on periodic command broadcasts from the computing system to the rail vehicle.

18. The system of claim 16, wherein the remote operation request is further determined based on a track geometry.

19. The system of claim 18, wherein the remote operation request is further determined based on a track bulletin associated with a speed restriction across a track segment, the track segment defined relative to the track geometry.

20. The system of claim 16, wherein the remote operation request for the rail vehicle is determined based on a set of dispatch instructions received from a user interface.

21. The system of claim 16, wherein the priority queue is based on a proximity of the rail vehicle to a speed restricted track segment.

* * * * *